US006261147B1

(12) United States Patent
Bach et al.

(10) Patent No.: US 6,261,147 B1
(45) Date of Patent: Jul. 17, 2001

(54) TOY BUILDING WITH ASSOCIATED FITTINGS

(75) Inventors: Erik Bach; Kaj Svejstrup Mikkelsen, both of Billund; Carsten Peter Michaelsen, Vejle; Philip Marshall Kushner, Greve, all of (DK)

(73) Assignee: INTERLEGO AG, Baar (CH)

( * ) Notice: Subject to any disclaimer, the term of this patent is extended or adjusted under 35 U.S.C. 154(b) by 0 days.

(21) Appl. No.: 08/752,396

(22) Filed: Nov. 20, 1996

(30) Foreign Application Priority Data

Nov. 20, 1995 (DK) ..... 1299

(51) Int. Cl.[7] ..... A63H 33/08
(52) U.S. Cl. ..... 446/105; 446/111
(58) Field of Search ..... 446/108, 110, 446/114–116, 120, 122, 482; 434/80

(56) References Cited

U.S. PATENT DOCUMENTS 4,270,302 * 6/1981 Dandia ..... 446/110
5,154,656 * 10/1992 Milsten ..... 446/120
5,647,181 * 7/1997 Hunts ..... 446/120

FOREIGN PATENT DOCUMENTS

133178 * 5/1933 (AU) ..... 446/482
512760 * 11/1992 (EP) ..... 446/482
1184651 * 7/1959 (FR) ..... 434/80
2405530 * 6/1979 (FR) ..... 434/80
2516806 * 5/1983 (FR) ..... 446/110
2042017 * 9/1980 (GB) ..... 446/124
2196773 * 5/1988 (GB) ..... 434/80
404163572 * 6/1992 (JP) ..... 434/80

* cited by examiner

*Primary Examiner*—Jacob K. Ackun, Jr.
*Assistant Examiner*—Faye Francis
(74) *Attorney, Agent, or Firm*—Pitney, Hardin, Kipp & Szuch LLP

(57) ABSTRACT

A toy building, such as a doll's house with associated fittings (8), said toy building comprising a bracing structure (1) and a number of substantially planar wall elements (5), and wherein the bracing structure (1) and the wall elements (5) are provided with coupling means (6,7) for releasably receiving the wall elements (5) in the bracing structure (1) of the toy building, and wherein the wall elements (5) and the fittings (8) are provided with complementary coupling means (9,10) intended for mounting of the fittings (8) on the wall elements (5).

5 Claims, 3 Drawing Sheets

TOY BUILDING WITH ASSOCIATED FITTINGS

The present invention relates to a toy building with associated fittings, said toy building comprising a structure which constitutes the bracing structure of the toy building, and a number of wall elements, and wherein the bracing structure and the wall elements are provided with coupling means for releasably receiving the wall elements in the bracing structure of the toy building.

Such toy buildings are known i.a. from U.S. Pat. No. 3,002,315 and U.S. Pat. No. 3,890,738. Since the buildings according to this prior art are, as described above, provided with coupling means for releasably receiving the wall elements in the bracing structure of the toy building, it is possible to remove wall elements from the toy building thereby providing a variety ways in which to access the toy building interior.

Additionally, it is possible with this prior art to rearrange and insert the wall elements at different locations, which elements form e.g. facades and partition walls in the toy building. Thus, this prior art distinguishes itself over the conventional toy doll's houses which are inseparably framed structures without the possibility of removing wall elements and the like.

Moreover GB patent application No. 2,196,773 teaches a system for the construction of a three-dimensional interior/setting, said system comprising individual wall elements which may be interconnected consecutively, where e.g. a particular corner element is provided to form corners in the three-dimensional interior/setting which may secure the wall elements at a fixed angle relative to each other.

The wall elements according to this prior art known from GB patent application No. 2,196,773 are provided with horizontal grooves for the suspension of fittings, such as cupboards and the like. The corner junctions according to this prior art not being readily separable, it will be associated with considerable difficulty to rearrange the individual facade elements relative to each other.

In the light of this prior art, it is the object of the present invention to provide a toy building, e.g. a doll's house of the type defined in the introductory part of claim 1, and which, contrary to the first-mentioned, known toy buildings, allow the releasable wall element which form part of the toy building to be used for another play purpose following removal thereof from the bracing structure of the toy building.

This is obtained by the invention according to claim 1 since the wall elements and the fittings are provided with complementary coupling means which are arranged for mounting of the fittings on the wall elements.

Hereby it is possible to remove the wall elements from the bracing structure of the toy building and mount them independently of each other to form interiors/settings outside the toy building where the wall elements are stabilised since the fittings are mountable on the wall element, whereby the wall elements and the fittings provide a sufficiently large ground surface to obtain good stability.

According to a convenient embodiment the complementary coupling means on the fittings and the wall elements are arranged for releasable coupling thereof as defined in claim 2, and these releasable couplings may according to claim 3 advantageously consist of frictional couplings or releasable snap-couplings.

Hereby it is obtained that the fittings may be rearranged on the individual wall elements, and in particular by the fact that the elements comprise frictional couplings or releasable snap-couplings means that a certain holding force between the fittings and the wall elements is obtained, thereby allowing the wall elements to be rearranged without the fittings being lost or vice versa.

FIG. 4 indicates how the complementary coupling means on the fittings and the wall elements consist of a number of grooves on the wall elements which grooves are vertical in the in-use position, and associated coupling elements on the fittings, and wherein the vertical grooves and the accompanying coupling elements on the fittings are so designed that the fittings may be displaced in the grooves after mounting.

Due to the frictional force between the fittings and the wall elements, the fittings may be positioned at different heights, thereby allowing e.g. lower cupboards for a kitchen to be displaced upwardly to form an upper cupboard, or they may be arranged on top of another lower cupboard whereby a high cupboard is provided.

By providing the grooves with positioning snaps as defined in claim 5, it is comparatively simple to position the individual fittings at a correct height relative to each other, despite the vertical grooves and the possibility of mutually displacing the fittings vertically relative to the wall elements, since the position snap clearly indicates the correct positioning.

According to invention the toy building may further comprise floor surfaces with coupling elements on their surfaces, and wherein the fittings have complementary coupling elements on the underside in the in-use position for releasably mounting the fittings on the floor surfaces. Thereby it is possible to mount the fittings on the floor surface or the wall elements as desired so as to allow removal of a wall element of the toy building without simultaneously removing the fittings.

By providing the coupling elements on the upper side of the floor surface at a mutually identical modular distance in a square pattern, and by the mutual distance between the vertical grooves corresponding to a full multiple of this modular distance, the fittings may be interconnected with both the floor surface and the wall element whereby the wall element will be very firmly attached to the toy building.

Invention features a particularly convenient embodiment where the coupling means for releasably receiving the wall elements in the bracing structure of the toy building has a coupling force that exceeds the coupling force obtained with the coupling force provided by the complementary coupling means for releasably mounting the. fittings on the wall elements.

Hereby it is simple to mount or dismount the fittings on a wall element already mounted in the bracing structure of the toy building without pulling the wall element inwards or outwards and without necessitating a counter force.

By providing the coupling means for releasably receiving the wall elements in the bracing structure of the toy building with a releasable tongue- and groove-connection between the vertical side edges of the wall elements and the bracing structure of the toy building, arid by making the toy building's bracing structure flexible at the tongue and the groove so as to allow the tongue and the groove to be pressed in and out of engagement, a particularly simple coupling thereof is obtained.

According to a preferred embodiment of the invention the wall elements for the toy building are provided with coupling elements on their undersides in the in-use position, said coupling means being designed for coupling the wall element onto the coupling elements on the floor surface.

Following removal of the bracing structure of the toy building, the wall element may consequently be erected e.g.

as a partition wall in the toy building interior thereby allowing for a further application for the wall element.

The invention will now be described in further detail with reference to the drawings, wherein.

Figure 1:
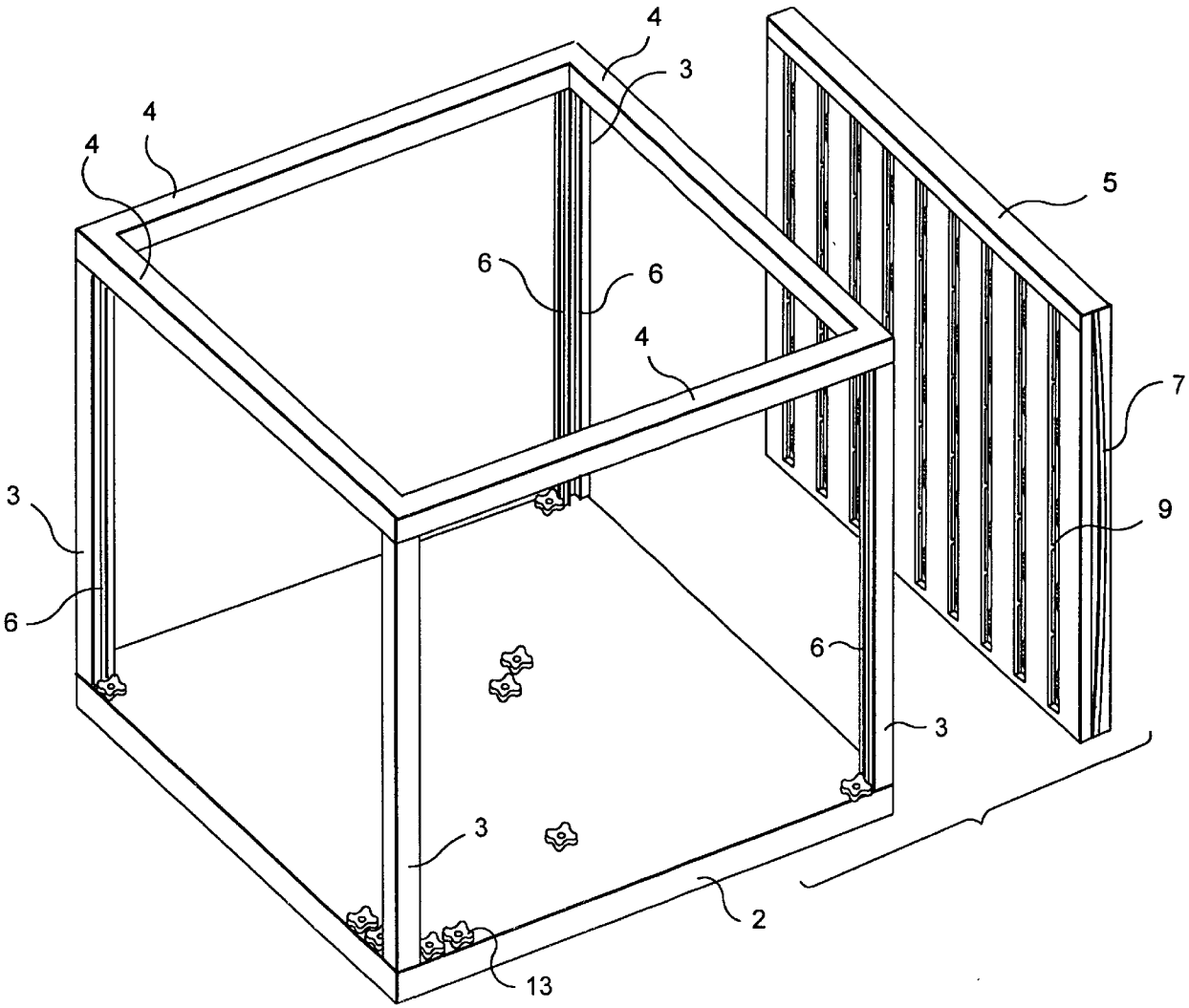
FIG. 1 illustrates a space element for a toy building according to the invention with associated wall element.

Thus FIG. 1 illustrates a compartment element 1 for a toy building according to the invention where the compartment element 1 consists of a bottom plate 2 with coupling studs 13 arranged in a square pattern, and where a grating structure is erected on the bottom plate 2 consisting of columns 3 and girders 4. FIG. 1 also illustrates a wall element 5 which is not mounted in the compartment element but shown separate from the compartment element.

Even though the invention is shown herein in accordance with a preferred embodiment where the compartment element 1 may be used for the construction of a toy building in combination with other corresponding compartment elements 1 by stacking or consecutive arrangement thereof, the invention may also be useful for other types of toy buildings and doll's houses.

According to the invention, however, the wall element 5 may be mounted between the columns 3 on the compartment element 1 by each of the columns 3 being provided with grooves 6 on the sides that face into the clearances of the grating structure, and by the wall element having a corresponding tongues 7 on each side. The wall element 5 having outer dimensions corresponding to the clearances of the grating structure, the wall element with the tongue 7 may be pressed into a clearance in the grating structure whereby the columns 3 will be deformed outwardly and allow the tongue 7 to engage with the grooves 6 on the columns 3.

Moreover, according to a convenient embodiment these columns may have a cross-section with a length and a width which correspond to a multiple of the modular distance between the coupling studs 13 on the bottom plate 2.

As will appear from FIG. 1, the wall element 5 according to the invention is provided with vertical parallel guides 9 as will be explained in further detail below.

Figure 2:
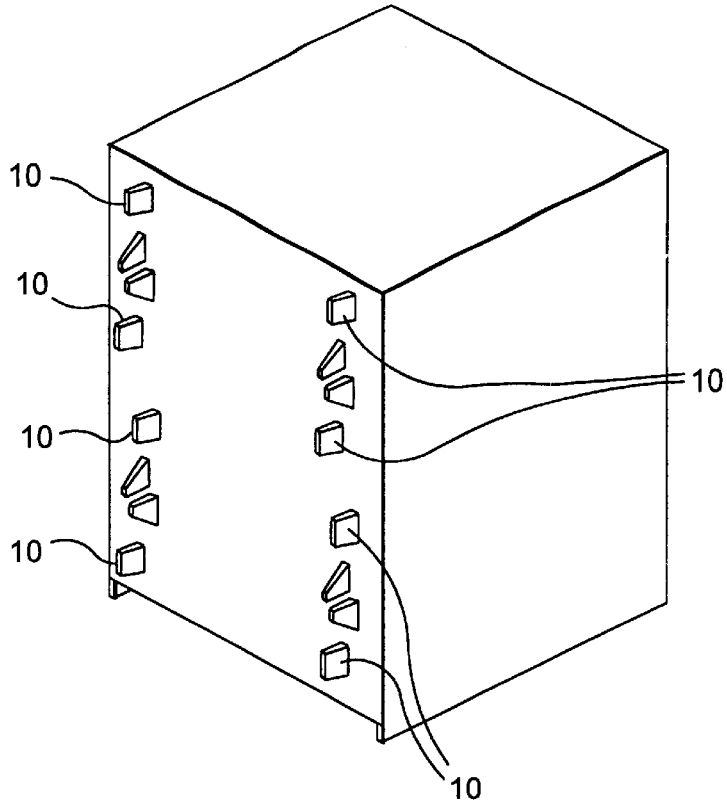
FIG. 2 is a rear view of a fitting according to the invention, seen from above.
Figure 3:
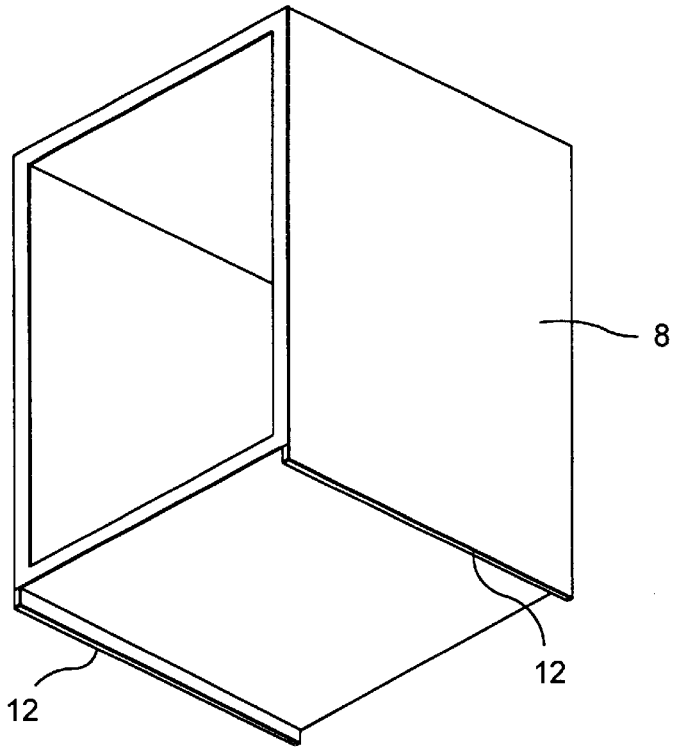
FIG. 3 is a front bottom view or the titting seen in FIG. 2.

FIGS. 2 and 3 depict a fitting 8, which is provided with protruding studs 10, as illustrated in FIG. 2, which are so designed that they may be introduced into the vertical grooves 9 on the wall element 5 by frictional coupling. This is obtained by the studs 10 having a shape and a mutual distance which cause the studs 10 to press against the sides of the vertical grooves 9 on the wall element 5. Thereby it is possible to reasably mount the fittings 8 on wall elements 5, and due to the grooves 9 being vertical, the fittings may be displaced upwards and downwards relative to the wall elements 5.

Figure 4:
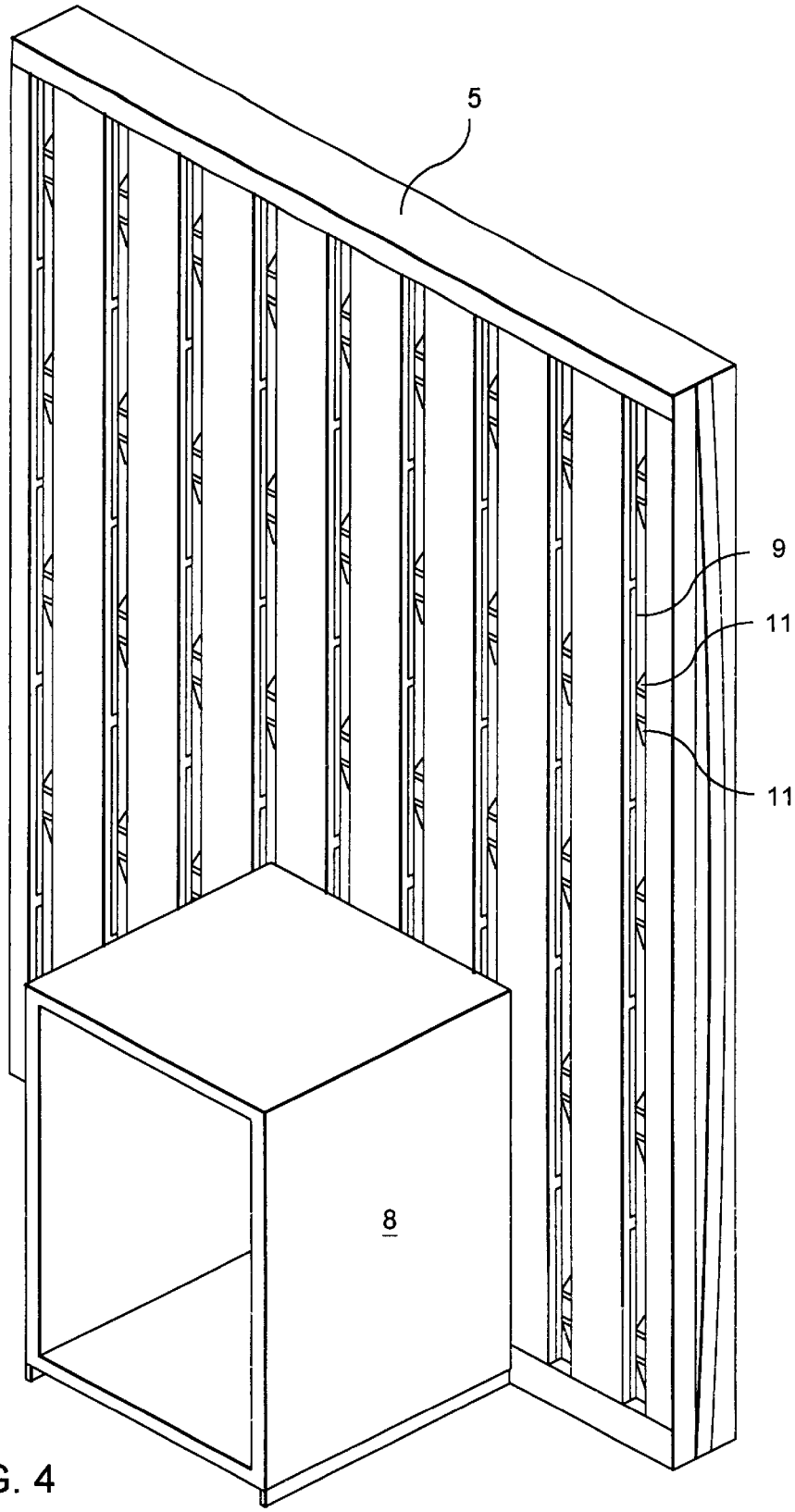
FIG. 4 illustrates a wall element according to FIG. 1 with a fitting according to FIGS. 2 and 3.

FIG. 4 illustrates a wall element 5 with a fitting mounted thereon. Here it will also appear that the vertical grooves are provided with small positioning snaps 11 which makes it possible to position the fittings 8 at standardised heights on the wall elements 5, since the positioning snaps 11 may be felt by displacement of the studs 10 in the grooves 9. Thereby it is ensured that it is easy to arrange fittings 8 at the correct height without simultaneously eliminating the option of positioning the fittings 8 at an alternative height.

Since, as explained and in accordance with the invention, the fittings 8 may be mounted in this manner on the wall element 5, this wall element 8 may be used for playing purposes even though the wall element 5 is not mounted in the compartment element 1 and thus in the toy building.

Thus, the wall element 5 does not become superfluous when removed from the toy building but may be used e.g. for outlining a garden wall or the like, where the fitting 8 forms a larger ground surface for and thus it further stabilizes the wall element 5.

In FIG. 3 it is further illustrated that the underside of the fitting 8 is provided with coupling flanges 12 which may be interconnected frictionally with the coupling studs 13 on the bottom plate 2 in the compartment element 1. Thereby the fitting. 8 may be solidly mounted in the compartment element 1 without the fittings 8 necessarily being secured to a wall element 5

In the same manner the wall elements 5 may have coupling means (not shown) on the underside for mounting of the wall elements 5 on the coupling studs 13 of the bottom plate. Thereby the wall elements 5 may further be used as interior walls in the toy building.

If the coupling studs 13 are arranged with a modular distance relative to each other which corresponds to the distance between the grooves 9 or a fraction thereof, the further advantage is obtained that the fittings a may be coupled both in the grooves 9 and on the coupling studs 13 on the bottom plate 2.

Thereby the fitting is very well secured in the toy building, in addition to the securing provided by the tongue 7 on those wall elements 5, which are optionally mounted on the bottom plate 2 as interior walls, which tongue is able to engage with the vertical grooves 9 on a wall element 5 mounted as a facade in the compartment element.

It goes without saying that although the embodiment of the invention described above constitutes a preferred embodiment, it will be obvious to the skilled person that various alternative embodiments of the invention exist within the scope of the present invention. Thus, the number of wall elements may be varied without departing from the idea underlying the invention, and at the same time there is a wide variety options available for varying the shape of the individual elements and their dimensions relative to each other.

What is claimed is:

1. A toy building with associated fittings (8), said toy building comprising:

a brace member (1); and at least one substantially planar wall element (5), said bracing structure (1) comprising columns (3) and girders (4) defining walls and room divisions of the toy building;

wherein the brace structure (1) and the wall elements (5) are provided with complementary coupling means (6,7) for releasably receiving the wall elements (5) in the bracing structure of the toy building; and wherein the wall elements (5) and the fittings (8) are provided with complementary frictional or releasable snap coupling means (9,10) arranged for releasably mounting of the fittings (8) on the wall elements (5), said complementary coupling means and wall elements consisting of a number of vertical grooves (9) situated on the wall elements with associated coupling elements (10) on the fittings (8) and wherein the vertical grooves (9) and the associated coupling elements (10) on the fittings (8) are so arranged that following mounting on the wall elements (5), the fittings (8) are displaceable in the groves.

2. A toy building according to claim 1, wherein the grooves (9) are provided with positioning snaps (11) at the inside of the grooves (9) and spaced apart, said positioning snaps (11) being so arranged that they will be caused to be in contact with the coupling elements (10) on the fittings (8) when the latter are displaced in the grooves (9).

3. A toy building according to claim 2, further comprising floor surfaces (2) with coupling elements (13) on their surfaces, and wherein the fittings (8) have complementary coupling elements (12) on the underside in the in-use position for releasably mounting the fittings (8) on the floor surfaces (2).

4. A toy building according to claim 3, wherein the coupling elements (13) on the upper side of the floor surface (2) are arranged with a mutually identical modular distance in a square pattern, and that the mutual distance between the vertical grooves (9) correspond to an integer multiple of the modular distance between the coupling elements (13) on the floor surface (2).

5. A toy building according to claim 3, characterized in that the wall elements (5) are provided with coupling elements on their underside in the in-use position, said coupling elements being designed for coupling the wall element (5) onto the coupling elements (13) of the floor surface (2).

* * * * *